US005702492A

United States Patent [19]

Elsbree

[11] Patent Number: 5,702,492

[45] Date of Patent: Dec. 30, 1997

[54] SEMICONDUCTOR WAFER HUBBED SAW BLADE AND PROCESS FOR MANUFACTURE OF SEMICONDUCTOR WAFER HUBBED SAW BLADE

[75] Inventor: Charles N. Elsbree, Santa Rosa, Calif.

[73] Assignee: Dynatex International, Santa Rosa, Calif.

[21] Appl. No.: 660,587

[22] Filed: Jun. 11, 1996

Related U.S. Application Data

[62] Division of Ser. No. 357,504, Dec. 16, 1994, Pat. No. 5,588,419.

[51] Int. Cl.[6] ..... B28D 1/04

[52] U.S. Cl. ..... 51/307; 51/293; 51/309; 125/15; 125/18; 125/39

[58] Field of Search ..... 51/293, 295, 307, 51/309; 125/15, 18, 20, 39; 451/541, 548

[56] References Cited

U.S. PATENT DOCUMENTS

| | | | |
|---|---|---|---|
| 3,092,094 | 6/1963 | Griffin | 125/15 |
| 3,205,624 | 9/1965 | Weiss | 451/541 |
| 3,491,742 | 1/1970 | Weiss | 125/15 |
| 3,553,905 | 1/1971 | Lemelson | 451/541 |
| 4,180,048 | 12/1979 | Regan | 125/15 |
| 5,588,419 | 12/1996 | Elsbree | 125/15 |

*Primary Examiner*—Deborah Jones

*Attorney, Agent, or Firm*—Townsend and Townsend and Crew, LLP

[57] ABSTRACT

In a plating process for constructing a nickel/embedded abrading particle saw blade on a saw blade substrate, the step of plating abrading particles onto and within the supporting copper substrate is disclosed. The beveled edge of a circular aluminum saw blade blank is first coated with a thin zinc layer. Thereafter, copper and abrading particles are plated followed by conventional abrading particle and nickel plating. Conventional material removal thereafter follows at the saw blade side adjacent the circular saw blade blank, saw blade edge, and copper layer. With removal of the copper layer, abrading particles originally partially embedded in the copper layer are exposed for cutting. The need for electropolishing and garnating is eliminated in so far as exposure of abrading particles is concerned. The final saw blade product produced has uniform cutting edges on both sides with less likelihood of producing edge fractures, chips, or cracks in silicon wafers during separation. Improvements in the overall processing of the chip are disclosed including the use of circular electrodes, a reshaped plating basket having a conical bottom, a band of central perforations, and the use of a weak cobalt/nickel alloy to bind abrading particles to nickel of sufficient hardness.

7 Claims, 4 Drawing Sheets

SEMICONDUCTOR WAFER HUBBED SAW BLADE AND PROCESS FOR MANUFACTURE OF SEMICONDUCTOR WAFER HUBBED SAW BLADE

This is a Division of application No. 08/357,504 filed Dec. 16, 1996 now U.S. Pat. No. 5,588,419.

This invention relates to an improved semiconductor wafer hubbed saw blade. More particularly an improved saw blade and process for the manufacture of the saw blade is disclosed which results in a hubbed saw blade product produced without the requirement for electro-polishing to expose abrading particles, such as diamonds, in one of the saw blade edges.

BACKGROUND OF THE INVENTION

The fabrication of saw blades for cutting silicon substrates to separate produced integrated circuits one from another is a multi-step plating process adhering to the periphery of an aluminum saw blade blank. In the understanding of the invention that is set forth hereafter, it is necessary to carefully understand the prior art.

In the following description of the prior art, faults of the prior art will be identified with specificity. The reader will understand that invention is claimed in the discovery of these faults. It goes without saying that the discovery of the problem to be solved is part of the invention claimed herein.

Referring to FIG. 8, the invention herein relates to the fabrication of saw blade S having sufficient hardness to cut the silicon substrate T on which circuits are printed (see FIGS. 12A and 12B). A description of silicon substrate T will be first given followed by the details of prior art saw blade manufacture.

Referring to FIGS. 12A and 12B, silicon substrate T is illustrated having a plurality of electrical leads 14 imprinted thereon. Saw blade kerf K is illustrated cutting to electrical leads 14. In FIG. 12B, a desired saw blade kerf K is illustrated. The reader will observe that at edges 16 of saw blade kerf K, no visible cracking or shearing at the kerf edges 16 has occurred on silicon substrate T.

This situation is to be distinguished from the condition of saw blade kerf K illustrated in FIG. 12A. It will be observed that edge chipping, cracks, or fractures 18 are present on one side of edges 16. These cracks, chips, or fractures are analogous to splinters produced by wood saws on paneling where there is a defect of the saw. Here, however, such cracks, chips, or fractures interfere with the integrity of the produced circuit. Specifically, edge fractures 18 can interfere with the integrity of chips on the substrate that are ultimately separated. It will be seen that edge fractures 18 penetrate electrical leads 14. When it is remembered that ultimately produced integrated circuits sometimes have hundreds of such leads, and that a single crack 18 disrupting a single lead 14 can render an entire chip defective, edge fractures 18 pose a serious threat to chip process yield.

It now is useful to trace the prior art production of saw blades S for an understanding of those defects which can lead to edge fractures 18. Returning to FIG. 8, it will be seen circular aluminum saw blade hub 20 is provided with beveled edge 22. Circular aluminum saw blade hub 20 has a central aperture for attachment to a saw arbor. As will hereafter be set forth, it includes beveled edge 22 which when fully processed holds nickel/embedded abrading particle saw blade edge 80. It is the sequence of this abrading particle embedding that is altered to attain the process and article of manufacture of this invention.

It is important to realize that in the preferred case, diamonds will be the imbedded abrading particle. However, other abrading particles may as well be used. For example, other abrasive particles such as aluminum oxide, silicon carbide, or abrasive materials such as titanium may be used.

Accordingly, FIGS. 1A–1F are all sections taken along section 1—1 of FIG. 8 during various plating, etching and electro-polishing steps required to produce the saw blades. Such plating, etching and electro-polishing usually occurs when a plurality of saw blades S are mounted to a mandrel M (see FIG. 7) and electro-plated, etched or polished in processing vats V as illustrated in FIGS. 9 and 10.

The reader will understand that we only illustrate our plating vats having improvements. However, since such plating, etching and electro-polishing is well understood in the prior art, further illustration will not be included herein.

Referring to the illustration of the prior art sequence shown in FIGS. 1A–1F, the fabrication of saw blade S can be understood.

Referring to FIG. 1A, beveled edge 22 is dipped first in electrode-less zinc plating solution to deposit thin zinc layer 24. Zinc layer 24 has the property of adhering to the aluminum of saw blade S while presenting a substrate to which first copper and then nickel can be plated.

Continuing on with FIG. 1A, after placing of a thin zinc layer 24, copper layer 26 is added to beveled edge 22 over the zinc. There results the cross-section of FIG. 1A.

Referring to FIG. 1B, nickel/embedded abrading particle layer 28 is plated to beveled edge 22 over copper layer 26 and zinc layer 24. Such plating occurs by placing abrading particles of the desired size—for example 4 to 6 microns—in a nickel plating solution such as that schematically shown in FIGS. 9 and 10. Thereafter, and once plating has begun, the abrading particles are moved into suspension—typically by periodically bubbling air through the plating tank having abrading particles in the path of the air bubbles. The abrading particles are then moved into suspension—and thereafter gradually settle during the plating process. Some abrading particles are attracted to and become embedded in nickel being plated. This results in the configuration shown in FIG. 1B.

At this stage, all surfaces necessary for the production of saw blade S are plated. What remains is to remove and expose the plated abrading particles for cutting.

Referring to FIG. 1C, etching of the plated material from beveled edge 22 has occurred. This exposes one side of circular aluminum saw blade hub 20 for direct machining. Similarly, and referring to FIG. 1D, grinding of material from end edge 30 occurs.

Referring to FIG. 1E, then machining of beveled edge 22 occurs to leave an approximate five mil layer 32. Thereafter, and to reach the configuration of FIG. 1F, five mil layer 32 is chemically removed.

DISCOVERY OF THE PROBLEM

In the analysis of the prior art that led to this invention, it was required to generate a detailed understanding of the prior art. It is therefore useful to understand in detail, the cross-section 2—2 of FIG. 1F.

Referring to FIG. 2A, after removal of five mil layer 32 of aluminum of saw blade S, it will be seen that copper layer 26 is still intact. Further, the configuration of nickel/embedded abrading particle layer 28 is instructive. Specifically, all abrading particles 36 are imbedded up to—but never into—copper layer 26. When copper layer 26 is removed—either chemically or by garnating—abrading particles 36 will be embedded in the nickel of embedded abrading particle layer 28. These abrading particles 36 will never protrude from nickel/embedded abrading particle layer 28. This embedding of abrading particles 36 is not unlike the embedding of aggregate in a concrete form adjacent the walls of the form. Specifically, the abrading particles may have an edge adjacent the interface between the nickel and copper—but will never protrude from that interface. This copper side interface 40 is designated in FIGS. 1F and 2A.

Opposite or plated interface 42 is different. Specifically, and during the plating process, abrading particles 36 fastened to nickel/embedded abrading particle layer 28 so as to surface expose at least some of abrading particles 36.

It is known that if the blade configuration of FIG. 2A were to be used for cutting, exposing of abrading particles 36 is required. In order to achieve the required exposure of abrading particles 36 on copper side interface 40, electro-polishing is utilized. Specifically, the plating anode/cathode relationship is reversed for a period of time sufficient to remove nickel and expose abrading particles 36 from nickel/embedded abrading particle layer 28 at copper side interface 40. In the prior art fabrication, this step is individually accomplished for each saw blade S.

While this treatment is beneficial for copper side interface 40, it is detrimental to plated interface 42. Metal when removed from plated interface 42 leaves surface exposed abrading particles 36' (see FIG. 2) after the plating. These surface exposed abrading particles 36' can be directly traced to edge fractures 18 in saw blade kerf K. It is this realization which has resulted in the process and article of manufacture of this invention.

In the prior art method of manufacture, the step of electro-polishing is a critical step. Each saw blade is usually individually electro-polished. Further, either insufficient electro-polishing or too much electro-polishing can cause quality control rejection of the produced saw blade. When it is remembered that this rejection occurs at the very end of the saw blade production process, it can be understood that such rejection is expensive—occurring when the saw blade is almost completely finished.

SUMMARY OF THE INVENTION

In a plating process for constructing a nickel/embedded abrading particle saw blade on a saw blade substrate, the step of plating abrading particles onto and within the supporting copper substrate is disclosed. The beveled edge of a circular aluminum saw blade blank is first coated with a thin zinc layer. Thereafter, copper and abrading particles are plated followed by conventional abrading particle and nickel plating. Conventional material removal thereafter follows at the saw blade side adjacent the circular saw blade blank, saw blade edge, and copper layer. With removal of the copper layer, abrading particles originally partially embedded in the copper layer are exposed for cutting. The need for electro-polishing and garnating is eliminated in so far as exposure of abrading particles is concerned. The final saw blade product produced has uniform cutting edges on both sides with less likelihood of producing edge fractures, chips, or cracks in silicon wafers during separation. Improvements in the overall processing of the chip are disclosed including the use of circular electrodes, a reshaped plating basket having a conical bottom, a band of central perforations, and the use of a weak cobalt/nickel alloy to bind abrading particles to nickel of sufficient hardness.

BRIEF DESCRIPTION OF THE DRAWINGS

FIGS. 1A–1G are sequential processing diagrams illustrative of the prior art wherein:

FIG. 1A illustrates the beveled edge of a saw blade blank having zinc and copper plated thereon;

FIG. 1B illustrates the beveled edge of a saw blade blank having nickel/embedded abrading particle layer plated over the copper;

FIG. 1C illustrates the beveled edge of a saw blade blank with the plated layers removed from the beveled side of the saw blade;

FIG. 1D illustrates the beveled edge of a saw blade blank having the end plated material removed;

FIG. 1E illustrates the beveled edge of a saw blade blank being machined away in preparation for the chemical removal of the remaining aluminum;

FIG. 1F illustrates the edge of a saw blade blank after removal of the thin machined layer of aluminum;

FIG. 1G illustrates the edge of a saw blade blank after removal of the copper layer overlying the nickel/embedded abrading particle layer;

DESCRIPTION OF THE PREFERRED EMBODIMENT

Figure 1A:
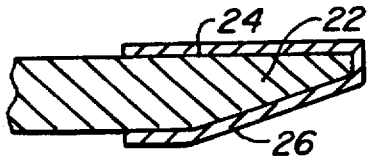
FIG. 1A. PRIOR ART
Figure 1B:
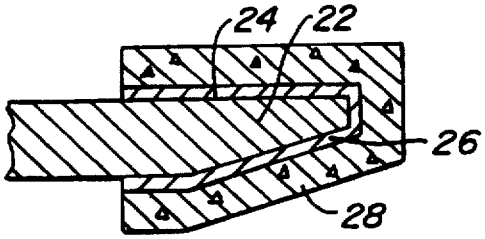
FIG. 1B. PRIOR ART
Figure 1C:
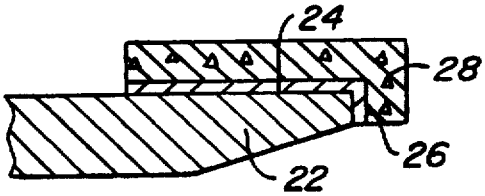
FIG. 1C. PRIOR ART
Figure 1D:
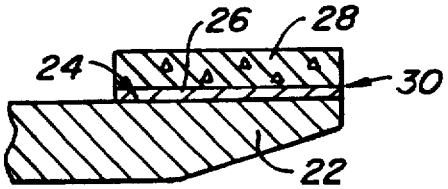
FIG. 1D. PRIOR ART
Figure 1E:
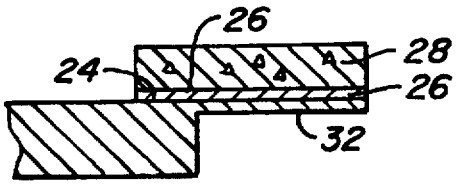
FIG. 1E. PRIOR ART
Figure 1F:
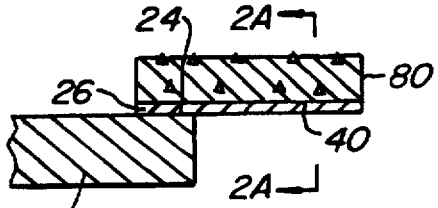
FIG. 1F. PRIOR ART
Figure 1G:
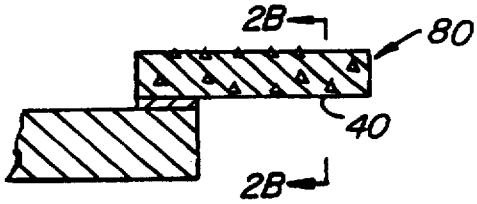
FIG. 1G. PRIOR ART
Figure 2A:
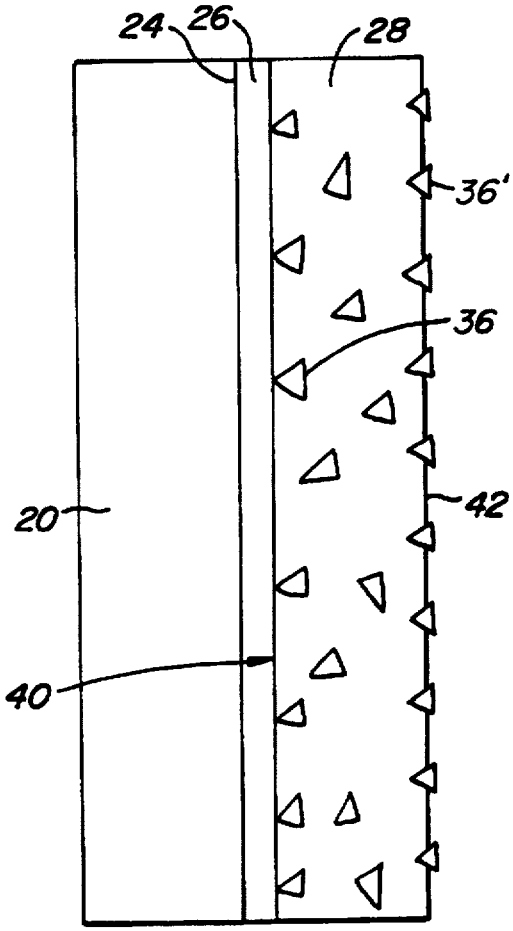
FIG. 2A. PRIOR ART
FIG. 2A is a sectional view across 2A—2A of FIG. 1F illustrating protrusion of abrading particles from one side of the nickel/embedded abrading particle layer with abrading particles on the opposite side being fully embedded with the nickel/embedded abrading particle layer.
Figure 2B:
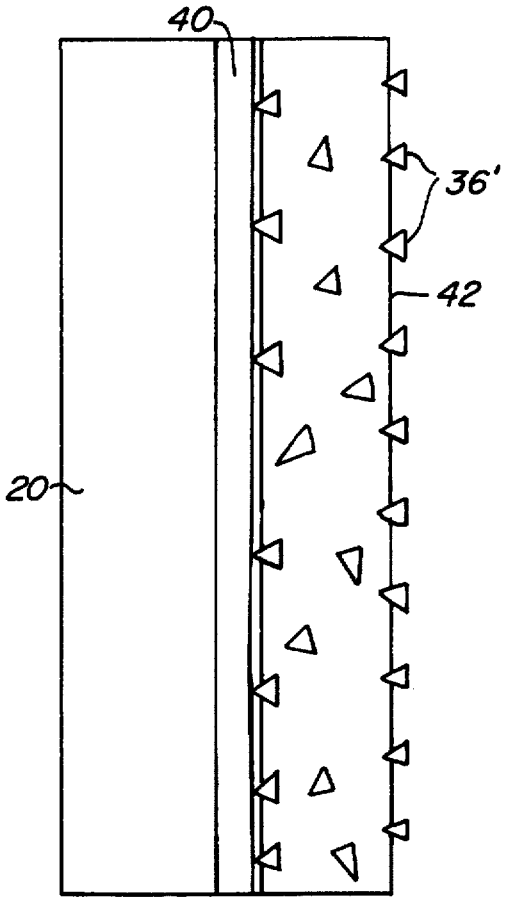
FIG. 2B is a sectional view across 2B—2B of FIG. 1G illustrating the prior art product after electro-polishing with the protrusion of abrading particles excessively from one side of the nickel/embedded abrading particle layer with normal protrusion on the opposite side of the nickel/embedded abrading particle layer.
Figure 3A:
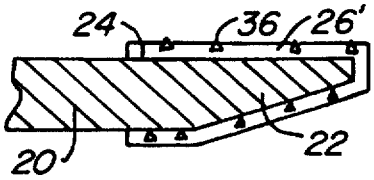
FIG. 3A illustrates the improvement of this invention to the step previously illustrated in FIG. 1A with abrading particles shown being plated to the copper layer to embed the abrading particles within the resultant copper layer.

Referring to FIG. 3A, the improvement in the process of this invention can be understood. As can be seen, circular aluminum saw blade hub 20 at beveled edge 22 has abrading particle embedded copper layer 26' plated over zinc layer 24. When abrading particle embedded copper layer 26' is plated, it will be seen that abrading particles 36 protrude from the surface of the copper layer.

Figure 9:
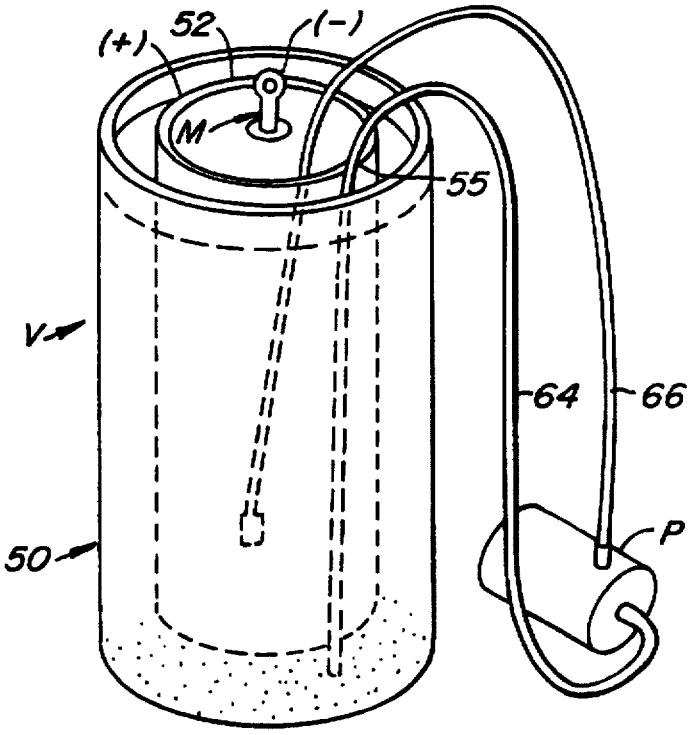
FIG. 9 is an improved plating configuration of this invention here shown adapted to the plating of abrading particles with copper onto the mandrel mounted saw blade blanks of this invention, it being noted that a diaphragm pump circulates and suspends the abrading particles for embedding to the copper layer being plated within the illustrated tank.

Plating occurs utilizing the apparatus illustrated in FIG. 9. Cylindrical plating tank 50 includes circular titanium mesh anode 52 having so-called sacrificial anodes of the material to be plated (here either nickel or copper). Into and inside of circular titanium mesh anode 52 there is placed the plating baskets illustrated in FIGS. 11A or 11B.

Figure 11A:
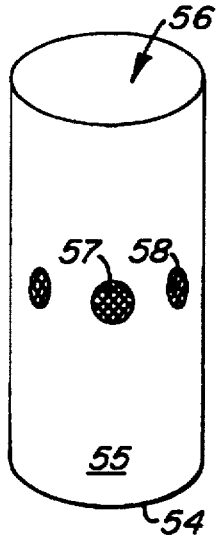
FIG. 11A. PRIOR ART
FIG. 11A is a plating basket of the prior art.

Referring to FIG. 11A, plating basket 55 is illustrated. Plating basket 55 is cylindrical in shape, includes closed bottom 54, open top 56 with central apertures 58 covered by mesh 57. Mesh 57 is sized to permit fluid and electrical communication into and out of plating basket 55 but to restrict abrading particles 36 to the interior of plating basket 55. For example, where the size of abrading particles 36 is between three (3) and five (5) mils, mesh 57 has a size smaller than the smallest of abrading particles 36.

Figure 7:
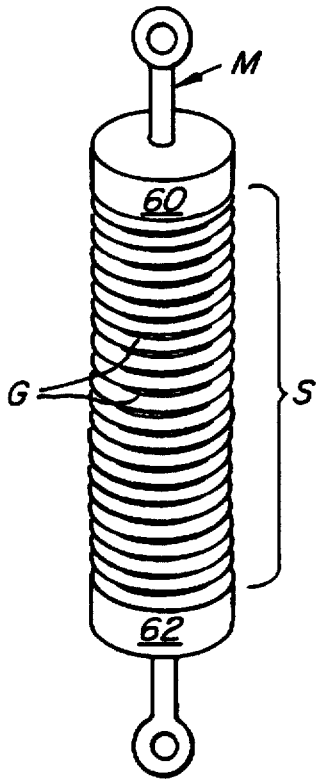
FIG. 7. PRIOR ART
FIG. 7 is a perspective view of a prior art plating mandrel utilized in the chemical plating, etching, and electro-polishing steps illustrated in this specification.
Figure 8:
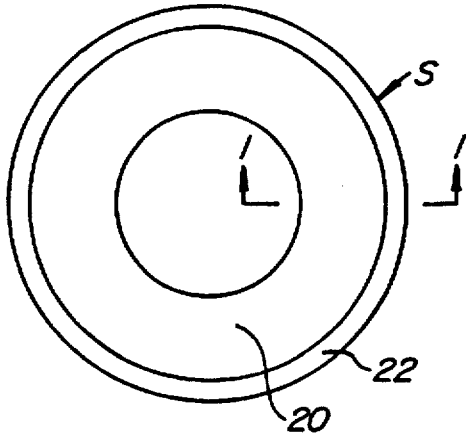
FIG. 8. PRIOR ART
FIG. 8 is a view of the saw blade blank to which the processing of this invention occurs.
Figure 10:
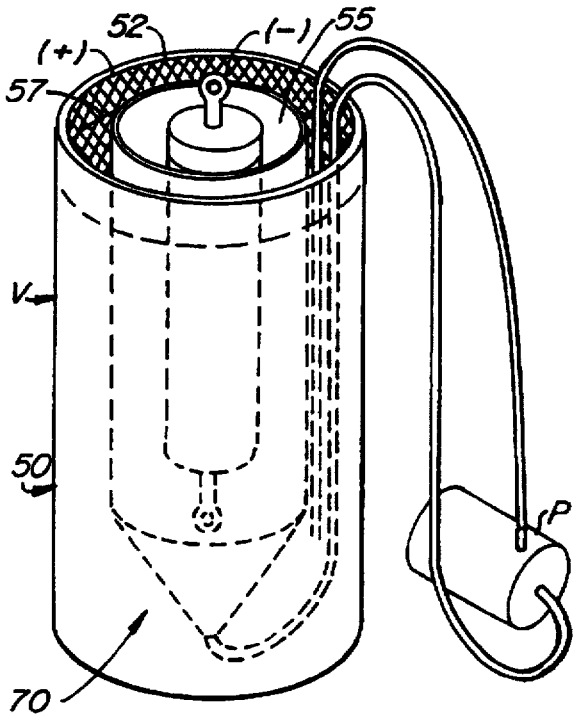
FIG. 10 is an improved plating tank similar to that illustrated in FIG. 9, the tank here being shown having a plating basket with a conical bottom for permitting efficient settling and redistribution by pumping of the abrading particles during the plating of the nickel.

Plating basket 55 is placed interiorly of circular titanium mesh anode 52 and allows electrical communication between a cathode placed within plating basket 55 and circular titanium mesh anode 52 (see FIG. 10).

Where plating is to occur, a plurality of saw blades S are mounted to mandrel M between upper mandrel plug 60 and lower mandrel plug 62. In between each saw blade S there is placed gaskets G. Gaskets G have the function of shielding the bulk of circular aluminum saw blade hub 20 while plating or other chemical processing occurs at the unshielded edge of beveled edge 22 (see FIG. 7).

Returning to FIG. 9, the remainder of the assembly can now be understood. Specifically, diaphragm pump P is illustrated having suction line 64 communicated into the interior of plating basket 55. Diaphragm pump P at discharge line 66 communicates to the top of plating basket 55. By controlling the timing and rate of pumping, abrading particles 36 within plating basket 55 are drawn from closed bottom 54 (see FIG. 11A) and kept in suspension during plating of abrading particle embedded copper layer 26' (see FIGS. 3A, 3B, 4 and 6). I have found that by substituting liquid pumping for air entrainment of the prior art, a more consistent and predictable suspension of abrading particles 36 results.

Plating of nickel/embedded abrading particle layer 28 is accomplished by similar apparatus illustrated in FIG. 10. Cylindrical plating tank 50 here contains nickel plating solution. Circular titanium mesh anode 52 has plating basket 70 therein.

Figure 11B:
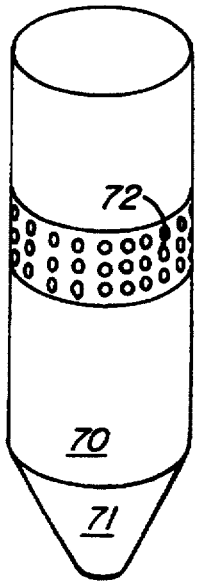
FIG. 11B is an improved plating basket of this invention having a conical bottom for abrading particle collection and illustrating a central band having numerous apertures with plating occurring with central and uniform electrical communication of the cathode and anode through the holes within the band.
Figure 12A:
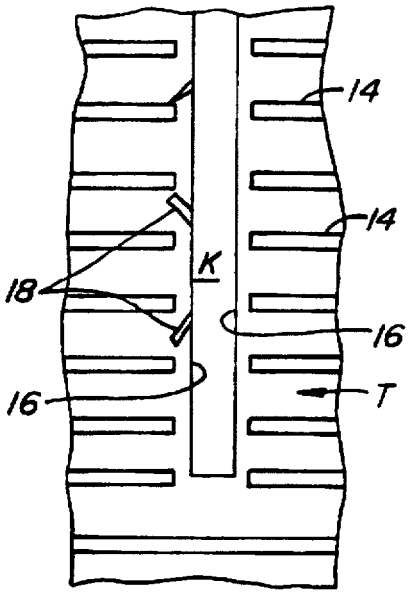
FIG. 12A. PRIOR ART
FIG. 12A illustrates a saw blade kerf of the prior art illustrating the cracking phenomena found along one edge of the saw blade kerf; and, FIG. 12B illustrates a saw blade kerf as ideally left in the wake of the saw blade of this invention.
Figure 12B:
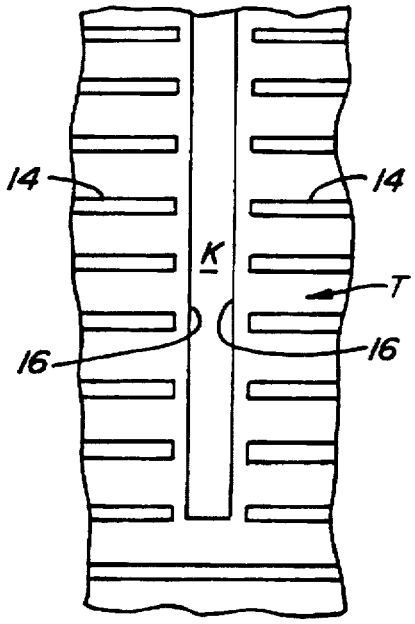

Plating basket 70 is illustrated in FIG. 11B and has conical bottom 71 to which suction line 64 is communicated adjacent the apex (see FIG. 9). Unlike the previously illustrated plating basket 55, plating basket 70 includes aperture band 72. Aperture band 72 is covered from the inside of plating basket 70 with mesh 57 (shown only in FIG. 11A).

Figure 3B:
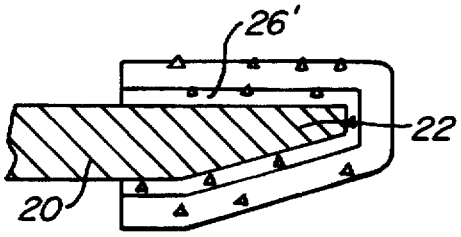
FIG. 3B is illustrates the plating of the nickel/embedded abrading particle layer illustrating that abrading particles embedded within the previously plated copper layer extend across and into the interface between the copper layer and the nickel/embedded abrading particle layer.
Figure 4:
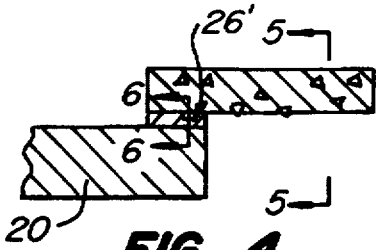
FIG. 4 is a side elevation cross-section of the embedded abrading particle hubbed saw blade of this invention.
Figure 5:
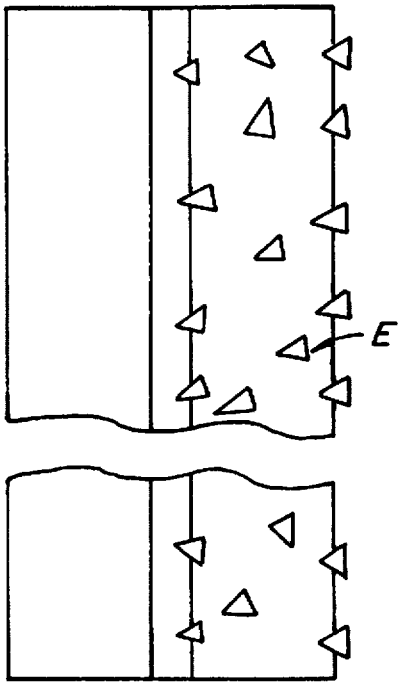
FIG. 5 is a view taken along line 5—5 of FIG. 4 illustrating the state of abrading particles embedded within nickel/embedded abrading particle layer after production of the saw blade to eliminate the need for electro-polishing.
Figure 6:
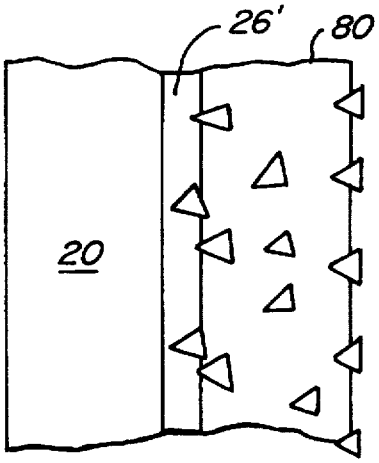
FIG. 6 is a view taken along line 6—6 of FIG. 4 illustrating the telltale embedding of abrading particles across the copper nickel interface of the ultimately produced saw blade of this invention.

Diaphragm pump P draws a suction from suction line 64 and discharges abrading particles 36 in suspension through discharge line 66 into the open and upper end of plating basket 70. Plating occurs with a sufficient amount of abrading particles to cause embedding of the abrading particles within the plated layers (see FIGS. 7 and 10). The result of this plating is illustrated in FIG. 3B.

It will be understood that I control the hardness of the ultimately produced nickel/cobalt alloy. Specifically, inorganic wetting agents and liquid hardeners are empirically varied to produce the harness desired. This enables both a hardness together with sufficient elasticity and porosity to hold the abrading particles in place for a long blade life. By way of example, utilizing a 2% cobalt alloy of the nickel, I have found that a hardness in the order of 420–550 Vickers produces a satisfactory saw blade product.

It will be understood that the combination of aperture band 72 combined with circular titanium mesh anode 52 produces a circularly even electrical field on mandrel M having saw blades S disposed for plating.

I have illustrated an electro-plating process in setting forth this invention. The reader will understand that other types of plating may be used as well. For example, so-called electrode-less plating may as well be used.

Returning to FIGS. 4 and 6, the product of this invention may be illustrated. Specifically, and referring to FIG. 6, it will be seen that the fabricated nickel/embedded abrading particle saw blade edge 80 is held to circular aluminum saw blade hub 20 by abrading particle embedded copper layer 26'. This is to be distinguished from copper layer 26. Further, it will be noted that it is characteristic of nickel/embedded abrading particle saw blade edge 80 that it is held to circular aluminum saw blade hub 20 by abrading particle embedded copper layer 26' with abrading particles 36 extending across the interface between the copper and nickel. In this way, it is possible to uniquely recognize the saw blade of this invention over saw blades of the prior art.

What is claimed is:

1. In a process of fabricating a cutting rim having nickel/embedded abrading particles on a circular aluminum saw blade hub, the process having the steps of:

plating zinc to the periphery of the aluminum saw blade hub;

plating copper over the zinc;

plating nickel and abrading particles over the copper to form a nickel/embedded abrading particles layer;

removing the nickel/embedded abrading particles layer and the copper from a radial edge and one side of the saw blade;

removing aluminum to expose the copper layer; and removing the exposed copper layer to expose the abrading particles for cutting;

the improvement comprising:

plating the copper with abrading particles whereby, when the plated nickel/embedded abrading particles layer is plated, the abrading particles extend across the copper/nickel interface.

2. The process according to claim 1 wherein the step of plating nickel and abrading particles includes using a cobalt alloy of nickel for the plating step.

3. The process according to claim 1 wherein:

at least one of the plating steps includes mounting the saw blade to a central cathode;

providing a cylindrical anode; and plating to the central cathode utilizing the field from the cylindrical anode.

4. The process according to claim 1 wherein the abrading particles are diamond.

5. The process according to claim 3 having the further steps of:

providing a plating basket having an open top, a closed bottom, cylindrical side walls, and mesh covered apertures wherein said mesh is sized to restrict abrading particles to the interior of the basket; and mounting saw blades centrally into the plating basket for plating from the anode to the cathode.

6. The process according to claim 5 having the further steps of:

providing a pump having a suction inlet and a discharge outlet;

drawing suction through the inlet of the pump at the bottom of the plating basket and discharging through the outlet of the pump at the top of the plating basket to keep abrading particles in suspension.

7. The process according to claim 6 having the further steps of:

providing the plating basket with a conical bottom to collect abrading particles settling from the plating solution; and providing suction through the inlet of the pump at the conical bottom of the plating basket to collect and redistribute the abrading particles.

* * * * *